United States Patent [19]

Lannert et al.

[11] Patent Number: 4,804,876

[45] Date of Patent: Feb. 14, 1989

[54] CABINET WITH LATCH MECHANISM

[75] Inventors: James W. Lannert, Oswego; Robert A. Studinski, Big Rock; Florian A. Walter, Aurora, all of Ill.

[73] Assignee: Lyon Metal Products, Incorporated, Aurora, Ill.

[21] Appl. No.: 38,942

[22] Filed: Apr. 16, 1987

[51] Int. Cl.[4] ..... E05C 7/06

[52] U.S. Cl. ..... 312/221; 292/DIG. 40

[58] Field of Search ..... 312/216–221; 292/DIG. 39, DIG. 40

[56] References Cited

U.S. PATENT DOCUMENTS

| | | | |
|---|---|---|---|
| 1,654,163 | 12/1927 | Evans | 292/DIG. 39 |
| 2,180,630 | 11/1939 | Hearn | 312/221 X |
| 3,497,280 | 2/1968 | Olree et al. . | |
| 3,622,216 | 5/1970 | Haunost . | |
| 4,057,306 | 6/1976 | Resch, Jr. . | |
| 4,239,309 | 7/1979 | De Fouw et al. . | |
| 4,303,287 | 2/1980 | Taplin . | |
| 4,352,529 | 11/1980 | Steinke . | |
| 4,394,056 | 7/1983 | Janke | 312/216 |
| 4,525,012 | 5/1983 | Dunner . | |

*Primary Examiner*—Joseph Falk

*Attorney, Agent, or Firm*—Emrich & Dithmar

[57] ABSTRACT

The cabinet comprises a case carrying a plurality of slidably mounted drawers. At the back of the drawers a latch bar is vertically oriented and pivotal between latch and unlatch positions. The bar has a flange which fits into keeper structure on a clip protruding from each drawer in the latch condition. A camming surface on each clip moves the latch bar to a latch position after one drawer is withdrawn so that none of the other drawers can be withdrawn. As the drawer is closed, another camming surface on the clip moves the latch bar back to an unlatch position. To insure alignment of the last mentioned camming surface with the latch bar, a slot is provided in the clip on each drawer which slot is aligned with an alignment flange attached to the case.

20 Claims, 4 Drawing Sheets

CABINET WITH LATCH MECHANISM

BACKGROUND OF THE INVENTION

This invention relates to a cabinet including a plurality of drawers and latch structure which prevents one drawer from being opened when another drawer is already opened.

There have been such cabinets in the marketplace and described in prior patents. In these cabinets, a drawer interlatch mechanism prevents more than one drawer from being opened at any one time. In other words, once one drawer is opened, the interlatch mechanism prevents the other drawers from being opened. The opening of two drawers could move the center of gravity forward sufficiently to tip the cabinet. One such prior structure includes a vertical latch bar at the rear of the cabinet which is rotatable to engage and disengage with an associated clip on each drawer. When a drawer is opened, it automatically moves the latch bar to its latch position to prevent other drawers from being opened. As the opened drawer is closed, it engages the latch bar and rotates it to the unlatch position to enable the closed drawers to then be opened.

The drawers are mounted for sliding movement between opened and closed positions. However, because of tolerances and the like, the drawers tend to have some side-to-side movement as they are closed. As a result, the drawer clip may not be precisely aligned with the latch bar to actuate same.

SUMMARY OF THE INVENTION

It is therefore an important option of the present invention to align the clip with the latch bar as the associated drawer is closed.

Another object is to provide an improved latch mechanism whereby all the drawers may be locked or unlocked, but when they are unlocked, opening one drawer prevents opening any other drawer.

In summary, there is provided a cabinet comprising a top member, a bottom member, a pair of side members, article support means slidably mounted on the side members and being slidable between a fully opened position and a fully closed position, an elongated latch bar rotatably mounted to the top and bottom members and being rotatable between latch and unlatch positions, an actuator on the article support means, the actuator including first means for rotating the latch bar to the latch position thereof as the article support means is closed, the actuator including second means for rotating the latch bar to the unlatch position thereof as the article support means is being closed, an elongated flange attached to the top member and to the bottom member and being substantially parallel to the latch bar and spaced therefrom, alignment means on the article support means and having a notch therein laterally aligned with the flange, the notch having a width greater than the thickness of the flange, the notching being located to receive the flange as the article support means is being closed to properly align the first means of the actuator with the latch bar.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 2:
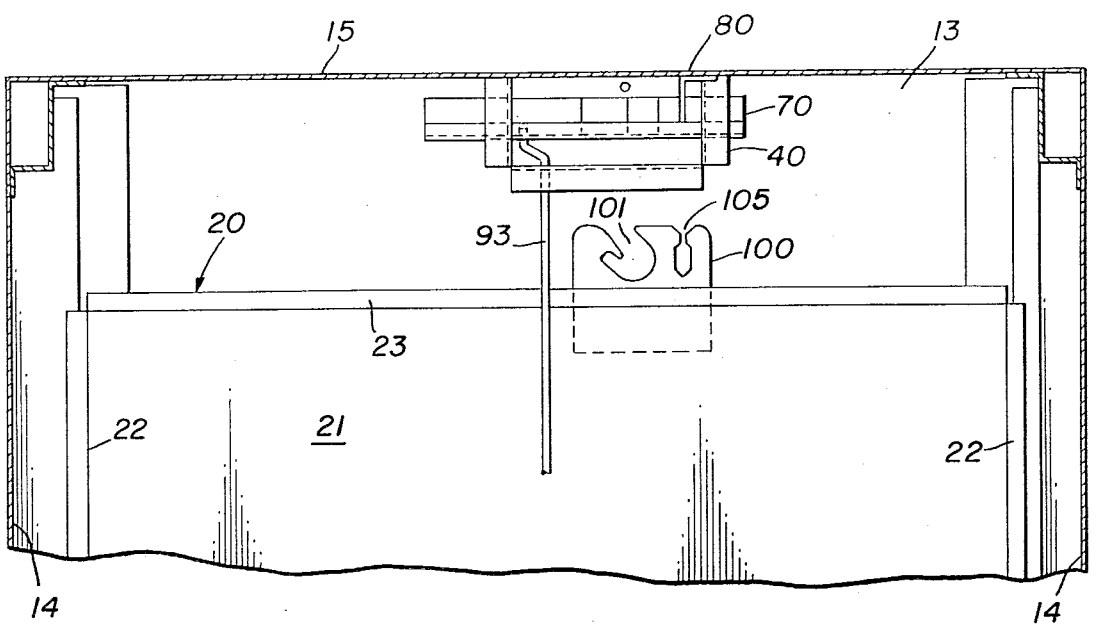
FIG. 2 is a fragmentary view in horizontal section taken along the line 2—2 of FIG. 1, on an enlarged scale.
Figure 3:
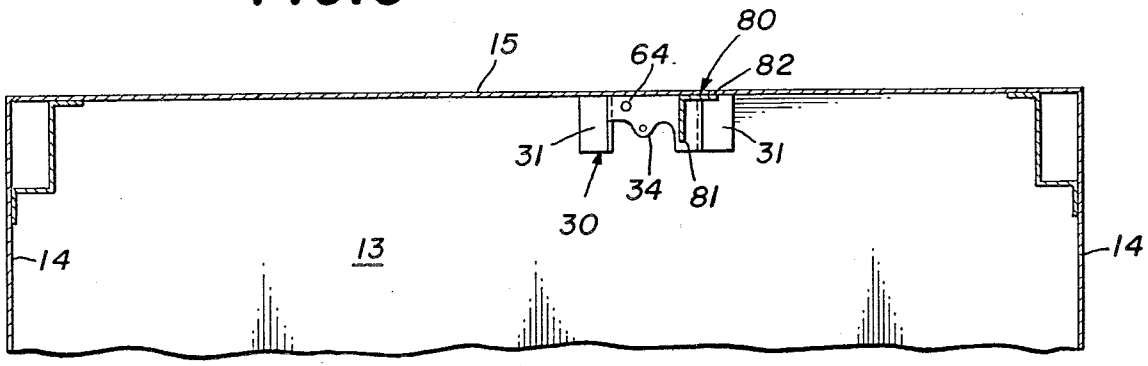
FIG. 3 is a fragmentary view in horizontal section taken along the line 3—3 of FIG. 1, on an enlarged scale.
Figure 1:
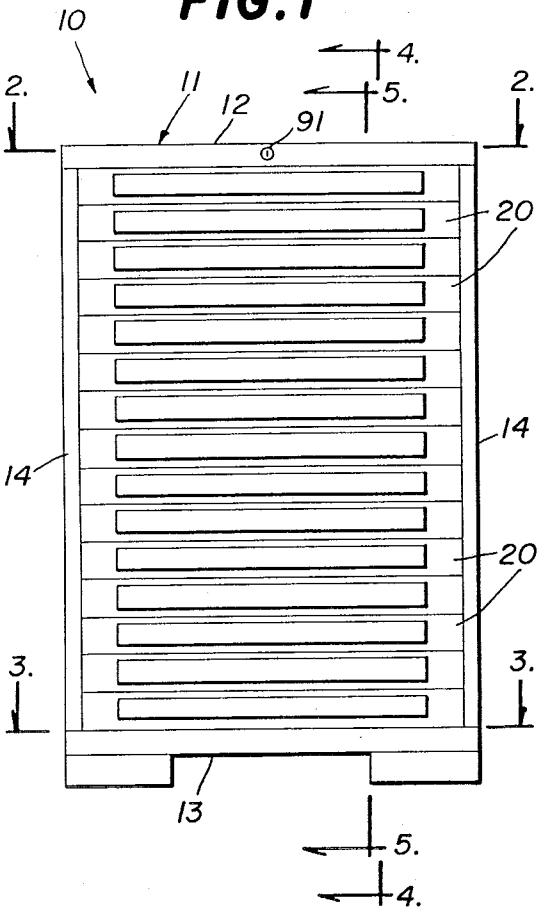
FIG. 1 is a front elevational view of a cabinet incorporating a latch mechanism constructed in accordance with the features of the present invention.
Figure 5:
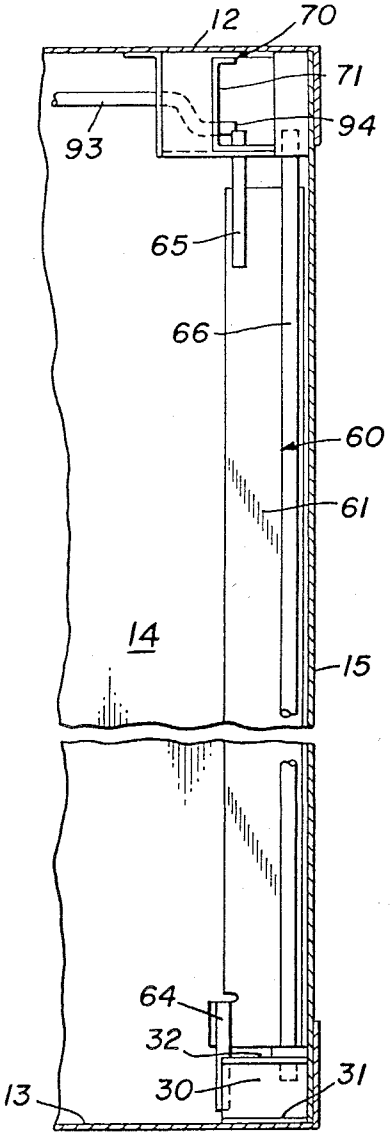
FIG. 5 is a fragmentary view in vertical section taken along the line 5—5 of FIG. 1, on an enlarged scale.

Referring now to the drawings, and particularly to FIG. 1 thereof, there is illustrated a cabinet 10 made in accordance with and embodying the principles of the present invention. The cabinet 10 includes a case 11 having a top 12, a base 13, a pair of sides 14, and a rear wall 15 (FIG. 2). A set of fifteen drawers 20 are disposed in the case 11.

Referring to FIGS. 2–6, each drawer 20 includes a bottom 21, a pair of sides 22 and a rear wall 23. There is provided a generally U-shaped bracket 30 having attachment flanges 31 welded to the base 13 of the cabinet 10. The bight flange 32 has a hole 33 near one end thereof, a forwardly protruding ear 34 generally at the center and a notch 35 near the other end thereof.

There is provided a latch housing 40 having a bottom wall 41, a pair of end walls **42*a*, 42*b* and a front wall 43. Each of the end walls 42*a*, 42*b* has a generally rectangular opening 44 of the same size. The bottom wall 41 has a hole 45, a square opening 46 (FIG. 7), the two parallel side edges of which define stops 47 and 48. Also in the bottom wall 41, next to the end wall 42*a* is a notch 49. Formed in the front wall 43 near to the wall 42*b* is a hole 50. The tops of the end walls 42*a* and 42*b* are bent outwardly and the top of the front flange 43 is bent forwardly to define attachment flanges which are welded to the top 12 of the cabinet 10**.

There is provided a latch bar 60 which includes a vertically extending main wall 61. At the front of the main wall 61 is a flange 62 which is folded over upon itself at an acute angle with the main wall 61. A tab 63 coplaner with the main wall 61 has welded thereto a depending pin 64, the axis of which is generally vertical. A second pin 65 is welded to the upper end of the main wall 61 and it is also oriented vertically. A rod 66 which is longer than the main wall 61 is welded to the rear thereof so as to protrude from its ends.

The upper end of the rod 66 extends through a spacer 67 into the hole 45 in the latch housing 40. The lower end of the rod 66 passes through a thrust bearing 68 into the hole 33 in the bracket 30. Accordingly, the latch bar 60 is rotatable about a vertical axis with respect to the bracket 30 and the latch housing 40. A torsion spring 69 has one end inserted through a hole in the ear 34 of the bracket 30 and has its other end encircling the pin 64, to bias the latch bar 60 in an over-center arrangement, that is, clockwise or counterclockwise, as the case may be. The pin 65 protrudes through the square opening 46 (FIG. 7) of the latch housing 40.

Figure 10:
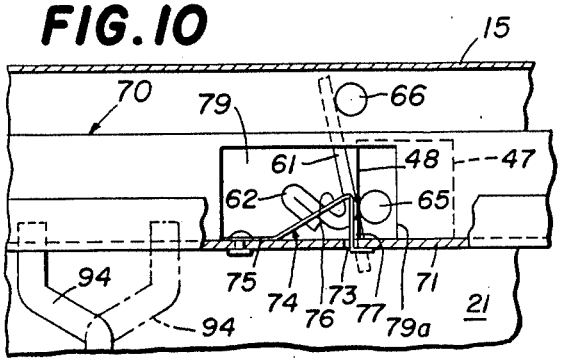
FIG. 10 is a fragmentary view in horizontal section depicting certain parts of the lock mechanism in their locked position.
Figure 11:
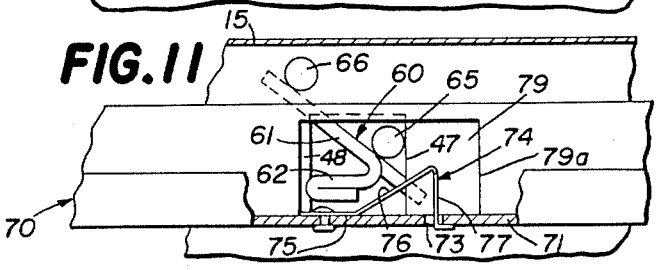
FIG. 11 is a view like FIG. 10 but with the parts in their unlock position.

There is provided a lock slide 70 which is generally U-shaped in cross section, its upper flange being shorter than its lower flange. The front wall 71 has a slot 72 with rounded ends and a slit 73. Referring to FIGS. 10 and 11, as well as FIG. 6, a flat spring 74 has an attachment ear 75 riveted to the rear surface of the front wall 71. The flat spring 74 also has a rearwardly directed camming surface 76 and an abutment surface 77. The abutment surface 77 extends through the slit 73 and is bent at its forward end to limit the extent of movement of the spring 74 rearwardly. The bottom wall 78 of the lock slide 70 has a rectangular opening 79 with a right-hand edge **79*a*. The pin 65 extends through the opening 79. The lock slide 70 is located in the openings 44 of the latch housing 40** and is slidable with respect thereto.

Figure 4:
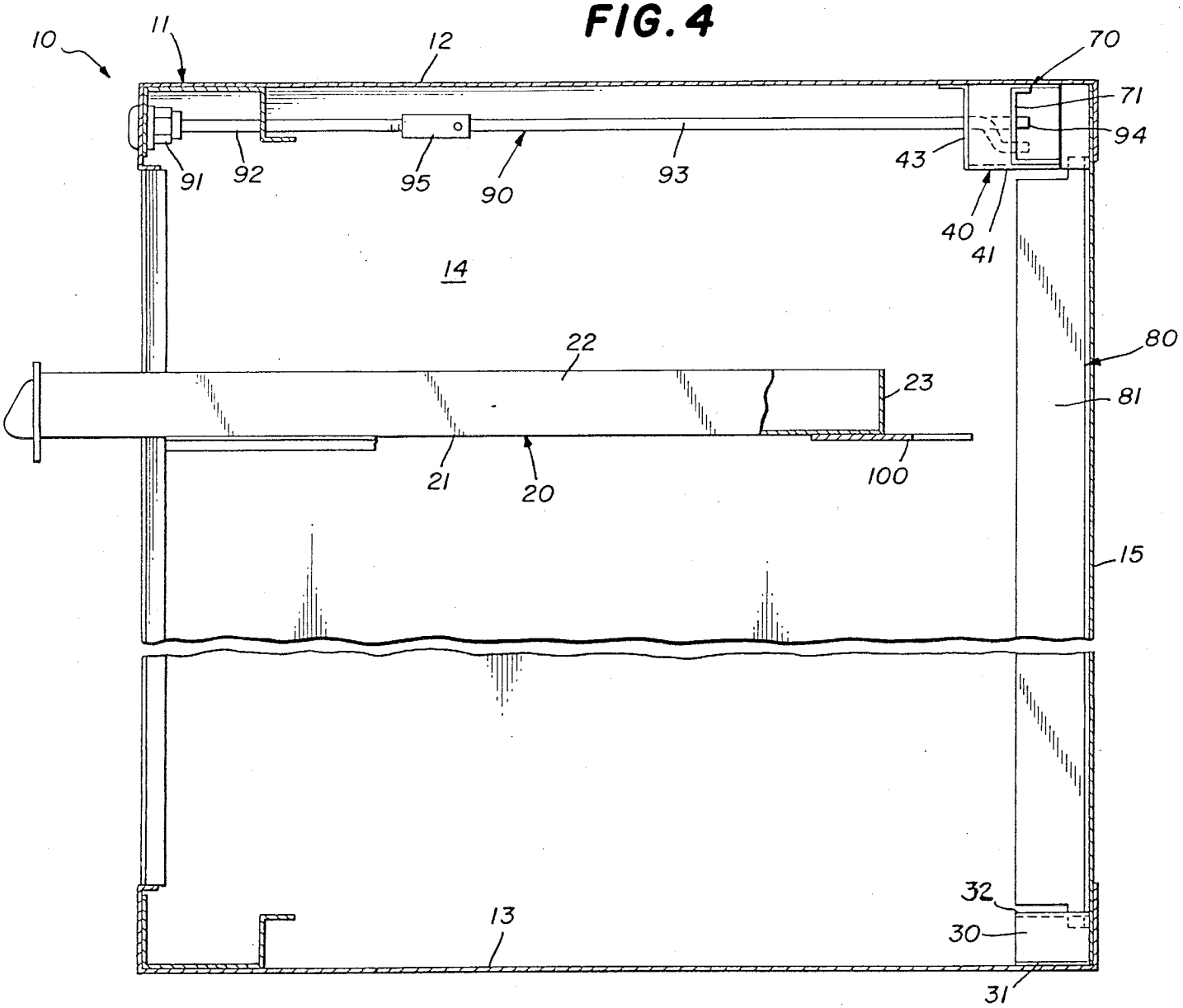
FIG. 4 is a fragmentary view in vertical section taken along the line 4—4 of FIG. 1, on an enlarged scale, with only one of the drawers being shown.
Figure 6:
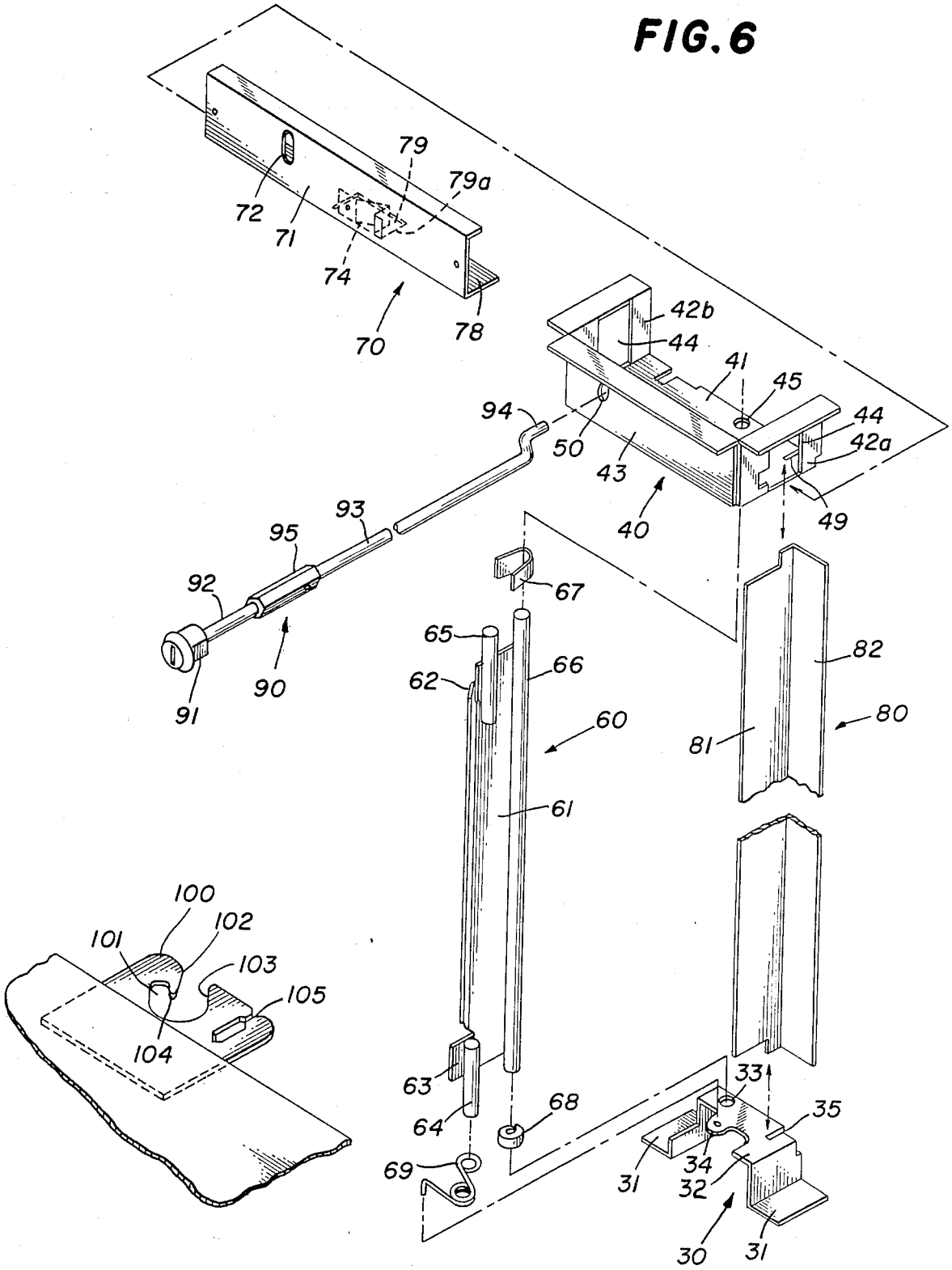
FIG. 6 is an exploded view of the drawer lock/latch system.

Referring to FIGS. 4 and 6, there is also provided an alignment member 80 in the form of an angle iron, having an alignment flange 81 and a reinforcing flange 82 that is welded to the rear wall 15. The alignment flange has a tab at its upper end which fits into the notch 49 in the latch housing 40. The alignment flange 81 has a tab as its lower end which fits into the notch 35 in the bracket 30. The alignment flange 81 is oriented vertically and is spaced from the latch bar 60.

There is also provided a lock mechanism 90 which includes a lock 91 mounted on the front, depending flange of the top 12. A rod 92 extends rearwardly from the lock 91. A rod 93 having an offset end 94 is connected to the rod 92 by means of a coupler 95. The offset end 94 extends through the hole 50 in the front wall 43 of the latch housing 40 and into the slot 72 in the lock slide 70.

The lock mechanism 90 is used to move the lock slide 70 between its lock and unlock positions. As the lock rod 93 is rotated, the offset end 94 rides up and down in the slot 72 to move the lock slide in one direction or the other. When a key is used to rotate the lock 91 clockwise, the lock slide 70 will move toward the right (such directions referred to herein are in the context of looking at the cabinet of FIG. 1 from the front), to its unlock position. In that position, the pin 65 will be located to the rear of the camming surface of the flat spring 74. The latch bar 60 is free to rotate between its latch and unlatch positions as will be described. The latch bar 60 is in its unlatch position when it is rotated counterclockwise so that the pin 65 contacts the stop edge 47 of the opening 46 in the latch housing 40. When the latch bar 60 is rotated clockwise such that the pin 65 contacts the stop edge 48 of the opening 46, the latch bar 60 will be in its latch position.

To move the lock slide 70 to its lock position, as depicted in FIG. 10, a key is used to rotate the lock 91 clockwise which causes the lock slide 70 to move toward the left. If the latch bar 60 was in its latch position, the camming surface 76, engages the pin 65 to cause the abutment surface 77 to be depressed through the slit 73 until the abutment surface passes the pin 64 whereupon the flat spring 74 reverts to its at-rest position. Then, as can be seen in FIG. 10, the pin 65 will be on the right side of the abutment surface so that the latch bar 60 cannot be rotated. If, on the other hand, the latch bar 60 was in its unlatch position (FIG. 11), clockwise rotation of the lock causes the spring 74 to be moved to the position of FIG. 10 without engaging the pin 65. The edge **79*a* engages the pin 65 and rotates the latch bar to its latch position as in FIG. 10. The latch bar can not be rotated. To move the lock slide 70 to its unlock position, as depicted in FIG. 11, the key is used to rotate the lock 91 counterclockwise which causes the lock slide to move to the right. The abutment surface 77 pushes the pin 65 counterclockwise, to place the latch bar 60** in its unlatch position.

Figure 7:
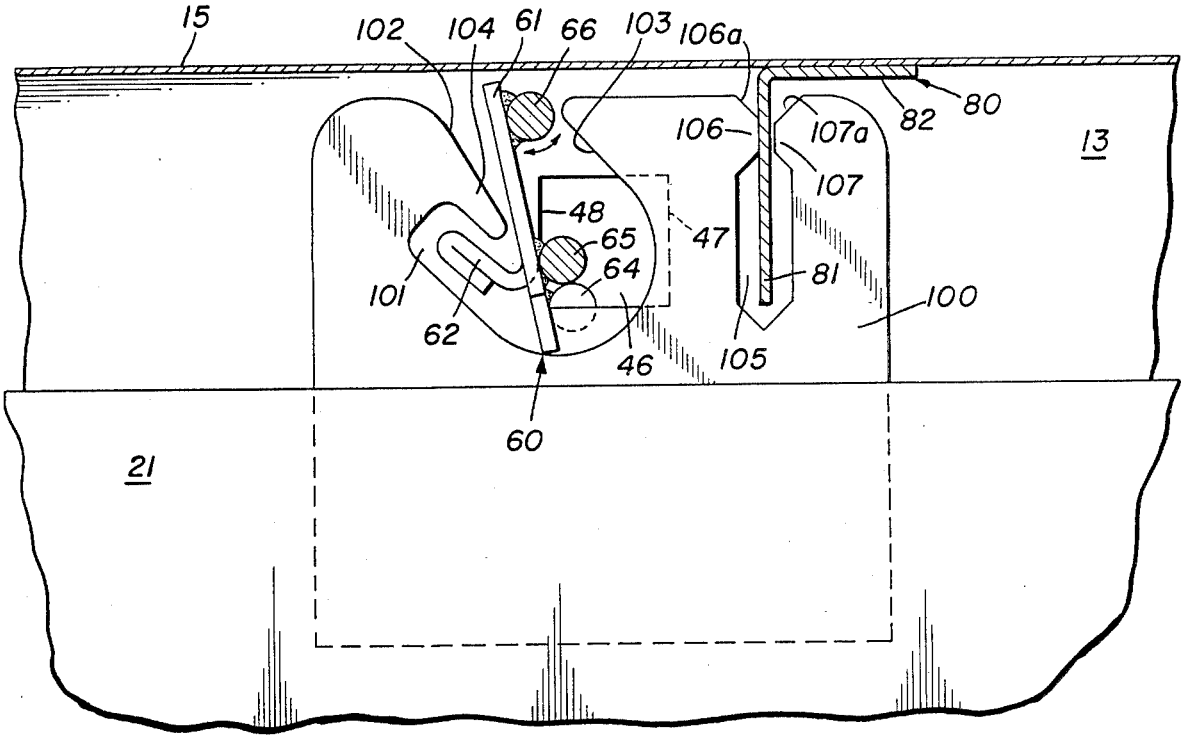
FIG. 7 is a view in section depicting the relationship of the parts of the latch mechanism in their latch position.

To move the latch bar 60 between its latch and unlatch positions, there is provided an actuater in the form of a latch clip 100 on the bottom rear of each drawer. Referring to FIGS. 6 and 7, the latch clip 100 is plate like and has a generally rectangular shape. Its front half defines an attachment portion secured to the underside of the associated drawer by means of welding, for example. The clip 100 is mounted to the right of center so as to be in alignment with the latch bar 60 and the alignment member 80. The latch clip 100 has a keeper slot 101 which is inclined forwardly and to the right, and opens toward the right. Located rearwardly of the keeper slot 101 is a first camming surface 102, the surface 102 being inclined generally in the same direction as the keeper slot 101. The forward surface of the keeper slot 101 extends further forwarding and then curves around so as to be directed rearwardly and to the left to define a camming surface 103. Preferably, the surfaces 102 and 103 are lubricated. The camming surfaces 102 and 103 are spaced apart and converge slightly. The space between the camming surfaces 102 and 103 accommodates the flange 62 on the latch bar 60. A finger 104, inclined forwardly and to the right is defined by the portion between the keeper slot 101 and the surface 102.

FIG. 7 depicts the latch structure in its latch condition. Specifically, the drawer 20 is closed and the latch bar 60 is in its latch position, meaning that it has been rotated clockwise such that the pin 65 is against the stop edge 48. The flange 62 resides in the keeper slot 101, whereby the finger 104 is located behind the flange 62. None of the drawers 20 can be pulled out because of the interference between the finger 104 and the flange 62.

Figure 8:
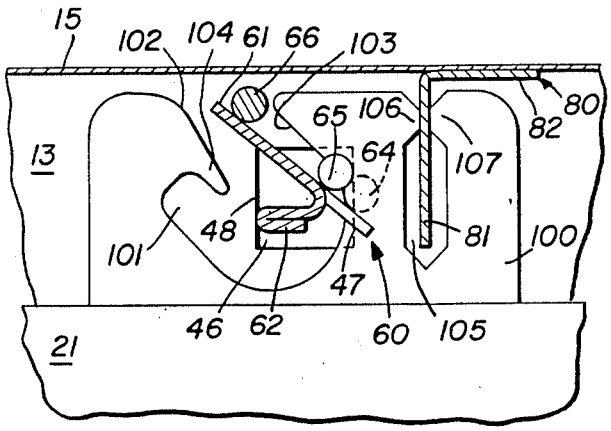
FIG. 8 is a view like FIG. 7, but on a smaller scale and in the unlatch position.

To unlock the drawer, the lock 91 is rotated to move the lock slide 70 toward the right and thereby pivot the latch bar 60 counterclockwise. When the latch bar 60 passes center, the spring 69 snaps the bar counterclockwise until the pin 64 strikes the stop edge 47 as shown in FIG. 8. Now the flange 62 is outside of the keeper slot 101 and the drawer may be withdrawn.

As the drawer is withdrawn, the camming surface 103 contacts the main wall 61 of the latch bar 60. As the drawer continues to be pulled out, the camming surface 103 pivots the latch bar 60 clockwise. When the latch bar passes its center position, the spring 69 snaps it clockwise until the pin 64 strikes the stop edge 48, to the position shown in FIG. 9. The latch bar 60 has thus been returned to its latch position, and the flange 62 is located in the keeper slot 101 of the other fourteen drawers. Thus, although the drawer depicted in FIGS. 7, 8, and 9 can be withdrawn, the others can not be.

Figure 9:
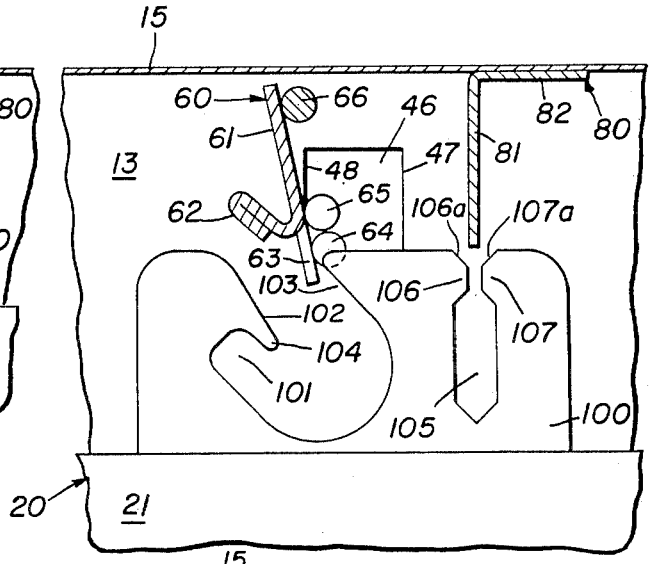
FIG. 9 is a view like FIG. 7, but on a smaller scale and with the drawer clip being disengaged from the latch bar.

When the drawer is thereafter closed, referring to FIG. 9, the camming surface 102 contacts the main wall 61 of the latch bar 60 to move it counterclockwise and in the space between the surfaces 102 and 103 back to the position shown in FIG. 8. Now, another drawer can be withdrawn, the camming surface 103 of which would return the latch bar 60 to its latch position and prevent subsequent withdrawal of any other drawer.

With the system just described, any drawer can be withdrawn, but thereafter none of the rest of the drawers can be withdrawn. After the one drawer has been closed, a different drawer can be withdrawn. However, if the lock mechanism 90 is then placed in its lock condition, the latch bar 60 can no longer be rotated in the counterclockwise direction. As previously described, the pin 65 would strike the edge 79*a* to prevent the latch bar from rotating. Then none of the drawers can be withdrawn.

Each of the drawers is mounted for sliding movement between opened and closed positions but, because of tolerances and the like, there is some tendency for side-to-side movement of the drawer as it is being closed. Referring to FIG. 9, as a drawer 20 is being closed, in order for the camming surface 102 to properly engage the flange 62 of the latch bar 60, alignment between the two must be fairly close. Any side-to-side movement tends to misalign these elements. To preclude that, there is provided structure to coact with the alignment member 80, namely, a slot 105 in the latch clip 100. The slot 105 is to the right of the elements 101–104 and is aligned with the alignment flange 81. Thus, as the drawer is closed, the alignment flange 81 enters the slot 105 which assures proper alignment of the flange 62 of the latch bar 60 with the camming surface 102. In the particular embodiment shown in the drawings, the slot 105 has a complex configuration. It is wider than the flange 81 but has two inwardly directed noses 106 and 107 respectively on the sides of the slot 105, laterally aligned with each other. Each nose preferably as a flat inner end, which flat inner ends are generally parallel to each other and spaced apart a distance slightly greater than the thickness of the flange 81, so that the flange 81 can enter into the space therebetween. The rear surfaces 106*a* and 107*a* respectively of the noses 106 and 107 are beveled to define ramps. As the drawer is closed, the flange 81 strikes, for example, the ramp 106*a* to guide the drawer slightly to the left or the ramp 107*a* to guide the drawer slightly to the right. Alternatively, the noses 106 and 107 could be longitudinally displaced instead of being laterally aligned. Preferably the slot is lubricated.

What has been described therefore is an improved cabinet with lock/latch structure in which all the drawers can be locked so that they cannot be opened. When the drawers are unlocked, only one at a time can be withdrawn, by means of a vertically oriented latch bar and associated clip on each drawer. To insure that the clip properly aligns with the latch bar as a drawer is closed, alignment structure is provided.

We claim:

1. A cabinet comprising a top member, a bottom member, a pair of side members, article support means slidably mounted on said side members and being slidable between a fully opened position and a full closed position, an elongated latch bar rotatably mounted to said top and bottom members and being rotatable between latch and unlatch positions, a plate-like member extending rearwardly from said article support means, one portion of said plate being an actuator, said actuator including first means aligned with said latch bar and being constructed and arranged to rotate said latch bar to the latch position thereof as said article support means is being closed, said actuator including second means for rotating said latch bar to the unlatch position thereof as said article support means is being closed, an elongated flange attached to said top member and said bottom member and being substantially parallel to said latch bar and spaced therefrom, another portion of said plate being an alignment means, said alignment means having a notch therein laterally aligned with said flange, said notch having a width greater than the thickness of said flange, said notch being located to receive said flange as said article support means is being closed to properly align said first means of said actuator with said latch bar.

2. The cabinet of claim 1, wherein each of said members is a wall.

3. The cabinet of claim 1, wherein said article support means is a drawer.

4. The cabinet of claim 1, and further comprising lubrication on said first means and on said second means and in said notch.

5. The cabinet of claim 1, and further comprising an elongated flange integral with and perpendicular to said first mentioned flange.

6. The cabinet of claim 1, and further comprising a first bracket attached to said top member and a second bracket attached to said bottom member, said elongated flange being fixably mounted on said brackets, said latch bar being rotatably mounted on said brackets.

7. The cabinet of claim 1, and further comprising lock structure associated with said latch bar.

8. The cabinet of claim 1, wherein said notch is defined by spaced apart sides, and further comprising a nose on each of said sides.

9. The cabinet of claim 8, wherein said noses are laterally aligned with each other.

10. The cabinet of claim 9, wherein the leading surface of each of said noses is inclined to guide said alignment flange.

11. A cabinet comprising a top member, a bottom member, a pair of side members, article support means slidably mounted on said side members and being slidable between a fully opened position and a fully closed position, an elongated latch bar rotatably mounted to said top and bottom members and being rotatable between latch and unlatch positions, an actuator on said article support means, said actuator including first means aligned with said latch bar and being constructed and arranged to rotate said latch bar to the latch position thereof as said article support means is being closed, said actuator including second means for rotating said latch bar to the unlatch position thereof as said article support means is being closed, an elongated flange attached to said top member and said bottom member and being substantially parallel to said latch bar and spaced therefrom, alignment means on said article support means and having a notch therein laterally aligned with said flange, said notch having a width greater than the thickness of said flange, said notch being located to receive the flange as said article support means is being closed to properly align said first means of said actuator with said latch bar, a first bracket attached to said top member and a second bracket attached to said bottom member, said elongated flange being fixedly mounted on said brackets, said latch bar being rotatably mounted on said brackets.

12. The cabinet of claim 11, wherein each of said members is a wall.

13. The cabinet of claim 11, wherein said article support means is a drawer.

14. The cabinet of claim 11, and further comprising a plate-like member extending rearwardly from said article support means, one portion of said plate being said actuator and another portion of said plate being said alignment means.

15. The cabinet of claim 11, and further comprising lubrication on said first means and on said second means and in said notch.

16. The cabinet of claim 11, and further comprising an elongated flange integral with and perpendicular to said first mentioned flange.

17. The cabinet of claim 11, and further comprising lock structure associated with said latch bar.

18. The cabinet of claim 11, wherein said notch is defined by spaced apart sides, and further comprising a nose on each of said sides.

19. The cabinet of claim 18, wherein said noses are laterally aligned with each other.

20. The cabinet of claim 19, wherein the leading surface of each of said noses is inclined to guide said alignment flange.

* * * * *